US009332829B2

(12) United States Patent
Wu et al.

(10) Patent No.: US 9,332,829 B2
(45) Date of Patent: May 10, 2016

(54) LIQUID DISPENSING ORAL CARE IMPLEMENT WITH LOW PROFILE PUMP

(75) Inventors: Donghui Wu, Bridgewater, NJ (US); John J. Gatzemeyer, Hillsborough, NJ (US)

(73) Assignee: COLGATE-PALMOLIVE COMPANY, New York, NY (US)

( * ) Notice: Subject to any disclaimer, the term of this patent is extended or adjusted under 35 U.S.C. 154(b) by 389 days.

(21) Appl. No.: 13/997,286

(22) PCT Filed: Dec. 23, 2010

(86) PCT No.: PCT/US2010/061950

§ 371 (c)(1), (2), (4) Date: Jun. 24, 2013

(87) PCT Pub. No.: WO2012/087322

PCT Pub. Date: Jun. 28, 2012

(65) Prior Publication Data

US 2013/0308994 A1 Nov. 21, 2013

(51) Int. Cl.
*A46B 11/00* (2006.01)
*A46D 3/00* (2006.01)

(52) U.S. Cl.
CPC ..... *A46B 11/0006* (2013.01); *A46B 11/002* (2013.01); *A46D 3/00* (2013.01); *A46B 11/0041* (2013.01); *Y10T 29/49567* (2015.01)

(58) Field of Classification Search
CPC .... A46B 11/00; A46B 11/001; A46B 11/017; A46B 11/002; A46B 11/0024; A46B 11/0041; A46B 11/0051; A46B 11/0055; A46B 11/0006; B05C 17/002; B05C 17/005; A45D 3/00; Y10T 29/49567
See application file for complete search history.

(56) References Cited

U.S. PATENT DOCUMENTS

| | | | | |
|---|---|---|---|---|
| 3,256,894 | A | 6/1966 | Gilbert | |
| 3,864,047 | A * | 2/1975 | Sherrod | A46B 11/0058 132/308 |
| 5,918,995 | A | 7/1999 | Puurunen | |
| 6,179,503 | B1 * | 1/2001 | Taghavi-Khanghah | A46B 11/0058 401/145 |
| 6,206,600 | B1 * | 3/2001 | Rosenberg | A46B 5/00 401/153 |

(Continued)

FOREIGN PATENT DOCUMENTS

| | | |
|---|---|---|
| CN | 201441083 | 4/2010 |
| DE | 20 2004 013 241 | 11/2004 |
| WO | WO 2009/100285 | 8/2009 |
| WO | WO 2009/142643 | 11/2009 |
| WO | WO 2011/094587 | 8/2011 |

OTHER PUBLICATIONS

International Search Report and the Written Opinion of the International Searching Authority issued in International Application PCT/US2010/061950 mailed Jan. 4, 2012.

*Primary Examiner* — David Walczak

(57) ABSTRACT

A fluid dispensing oral care implement having a low profile pump includes a head, a reservoir for storing an oral care fluid, at least one liquid outlet in the head, and a pump. The pump includes a flexible membrane movable between alternating pump intake and discharge motions. The pump includes inlet and outlet flap valves, which may be formed integrally from portions of the membrane. In one embodiment, the valves are integrally formed in the membrane as flexible cantilevered tabs movable between open and closed positions. In some embodiments, the pump may be mounted in the toothbrush head or forms the head. In some embodiments, the pump may be disposed in a neck or a handle portion of the toothbrush.

18 Claims, 11 Drawing Sheets

(56) References Cited

U.S. PATENT DOCUMENTS

| | | | |
|---|---|---|---|
| 7,219,848 | B2 | 5/2007 | Sweeton |
| 2007/0041779 | A1 | 2/2007 | Kuo |
| 2007/0154863 | A1 | 7/2007 | Cai et al. |
| 2007/0221681 | A1 | 9/2007 | Eisinga et al. |
| 2008/0181716 | A1 | 7/2008 | Gatzemeyer et al. |
| 2008/0189951 | A1 | 8/2008 | Molema et al. |
| 2009/0119859 | A1 | 5/2009 | Podolsky |

* cited by examiner

LIQUID DISPENSING ORAL CARE IMPLEMENT WITH LOW PROFILE PUMP

CROSS-REFERENCE TO RELATED PATENT APPLICATIONS

The present application is a U.S. national stage application under 35 U.S.C. §371 of PCT Application No. PCT/US2010/061950, filed Dec. 23, 2010 the entirety of which is incorporated herein by reference.

FIELD OF THE INVENTION

The present invention is directed to an oral care implement including a delivery system for a fluid, and more particularly to an oral care implement with a low profile pump.

BACKGROUND OF THE INVENTION

Oral care implements, particularly toothbrushes, are typically used by applying toothpaste to a bristle section followed by brushing regions of the oral cavity, e.g., the teeth, tongue, and/or gums. Some toothbrushes have been equipped with fluid reservoirs and systems for delivering auxiliary active agents, such as whitening agents, breath freshening agents, and the like.

Some efforts have been made to configure toothbrushes to deliver active agents at the time of brushing. Commonly assigned U.S. 2007/0154863 A1 which is incorporated herein by reference in its entirety, for example, describes an oral care implement having a reservoir containing an active agent and a user-activated pump for delivering the active agent through a channel and out of one or more outlets.

An improved oral care implement with a fluid delivery system and integrated compact pump is desired to minimize the size of the oral care implement.

BRIEF SUMMARY OF THE INVENTION

In one embodiment, a low profile pump is provided that may be readily incorporated into an oral care implement, such as a toothbrush, due to its compact design and small size. In one preferred embodiment, the pump may be a piezoelectric pump having an inlet valve and an outlet valve. The inlet and outlet valves may be integrally formed as part of a single flexible membrane used to provide intake and discharge pumping strokes that convey an oral care fluid from a reservoir disposed in the toothbrush to a user. The formation of the valves and the flexible membrane as an integral unit helps to reduce the volume of the pump and thus provides manufacturing ease and reduces costs.

A low profile pump according to the present invention is further ideally suited to be disposed in the head of a toothbrush due to its small size which allows the toothbrush head to retain a compact configuration comfortable for many users.

According to one embodiment, a liquid dispensing toothbrush is provided. The toothbrush includes a head supporting a plurality of tooth cleaning elements; a reservoir disposed in the toothbrush for storing an oral care fluid; at least one liquid dispensing outlet disposed in the head; and a pump disposed in the toothbrush. The pump is in fluid communication with the reservoir and the liquid outlet. In one embodiment, the pump includes a flexible membrane operable to pump the liquid. The membrane is movable between alternating intake and discharge positions. An inlet flap valve and an outlet flap valve are provided and disposed in the pump. In one embodiment, the inlet and outlet flap valves are formed as an integral part of the flexible membrane and may function as check valves allowing flow of the oral care fluid through the pump in a single direction from an inlet port to an outlet port. In one preferred embodiment, the pump discharges the oral care fluid through one or more flow dispensing outlets incorporate into the field of the tooth cleaning elements, which may include bristles and/or elastomeric members. The flap valves are disposed within a reference plane defined by the flexible member in some embodiments, which has opposing upper and lower membrane surfaces. In one embodiment, the pump is a piezoelectric pump and the actuator is a piezoelectric actuator.

According to another aspect of the invention, a method for fabricating a toothbrush with a pump is provided. In one embodiment, the method includes: providing a lower portion of a pump housing and an upper portion of the pump housing; inserting a flexible membrane having an actuator disposed thereon between the upper and lower portions of the pump housing; securing the upper portion of the housing to the lower portion of the housing for retaining at least a portion of the membrane between the upper and lower portions of the pump housing; and positioning the pump housing on the toothbrush. In additional embodiments, the method includes inserting the pump housing in a toothbrush head. According to a variation of the foregoing method, a method for fabricating a toothbrush with a piezoelectric pump is provided in which the step of securing the upper portion to the lower portion of the pump housing forms the toothbrush head. According to any of the foregoing methods, the methods may each further include a step of forming an inlet and outlet flap valves in the flexible membrane. In some embodiments, the flap valves are formed by cutting or stamping. In some embodiments, the pump is a piezoelectric pump and the actuator is a piezoelectric actuator.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

Figure 1:
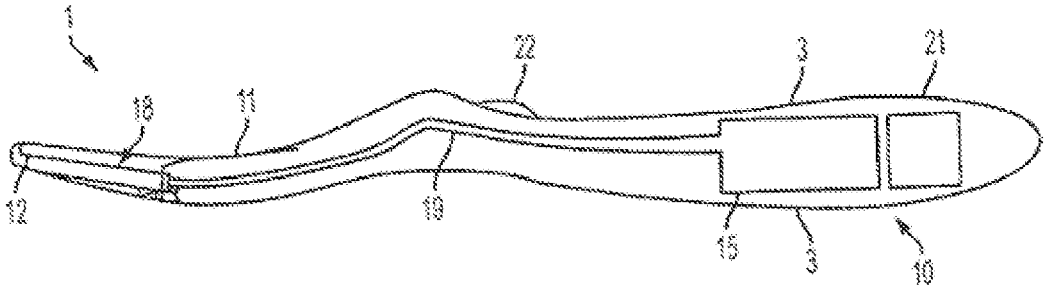
FIG. 1 is a side elevation view of a toothbrush construction having a liquid delivery system.

All drawings shown herein are schematic and not to scale.

DETAILED DESCRIPTION OF THE INVENTION

The following description of the preferred embodiment(s) is merely exemplary in nature and is in no way intended to limit the invention, its application, or uses.

The features and benefits of the invention are illustrated and described herein by reference to preferred embodiments. This description of preferred embodiments is intended to be read in connection with the accompanying drawings, which are to be considered part of the entire written description. In the description of embodiments disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures may be secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features; the scope of the invention being defined by the claims appended hereto.

FIG. 1 schematically illustrates a toothbrush 1 having a handle 10, a head 12, and a neck portion 11 connecting the handle 10 and head 12. The head 12 contains tooth cleaning elements 5, such as bristles and/or elastomeric cleaning elements or the like. A reservoir 15 is provided in the handle 10 for storing a liquid. For purpose of discussion only, the present disclosure describes the liquid as containing one or more active agents. However, it is understood that in some embodiments, the liquid stored in the reservoir 15 does not contain any active agent. In an alternative construction shown in FIGS. 13-17, the reservoir 15 may be provided within the neck portion 11 of the toothbrush 1. The handle 10 or other exterior portion of the toothbrush 1 may contain a delivery device actuator or switch, such as a user-actuated button 22, for activating a delivery device, such as a pump 18. The pump 18 may be located upstream or downstream of the reservoir 15.

Figure 2:
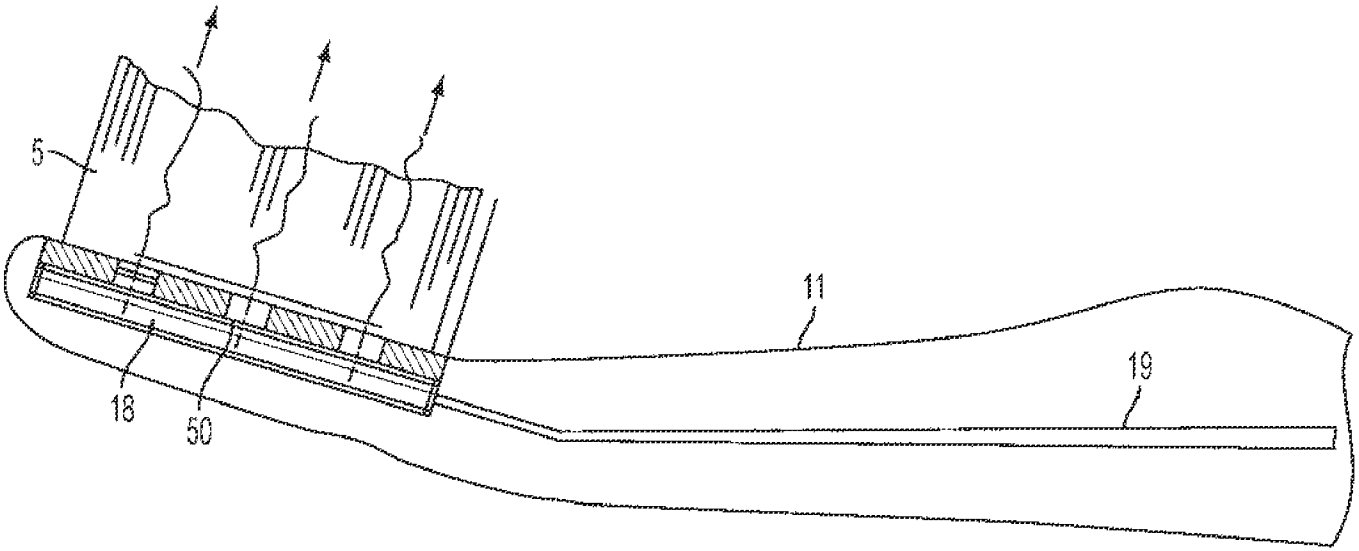
FIG. 2 illustrates an enlarged fragmentary cross-section view of the toothbrush construction of FIG. 1 including a powered delivery device in the head of the toothbrush.

In one construction, a micro piezoelectric pump 18 is positioned beneath the cleaning elements 5 in the toothbrush head 12. It is understood that while pump 18 is referenced as a micro piezoelectric pump 18, other types of pumps may be used as desired. In order to deliver active ingredients or active agents to a desirable location or to avoid clogging from residue toothpaste, the outlet(s) of the micro piezoelectric pump 18 are located at desirable locations, such as, in the vicinity of the cleaning elements 5 (top of the brush head 12), on the side of the brush head 12 opposite the cleaning elements 5 (bottom of the brush head 12), at the distal tip of the brush head 12 (the very front tip of the brush 12), or on the sidewalls of the brush head 12. Upon activation of the switch 22, the pump 18 draws a quantity of the liquid medium from the reservoir 15 through a channel toward the head 12. The liquid medium is delivered through one or more outlets 50 located within the bristle field. As shown in FIG. 2, outlets 50 may be spaced along the length of the bristle section to help disperse the liquid medium throughout the bristle field. Optionally, a plurality of outlets may be provided on both the surface of the head 12 that contains the tooth cleaning elements 5 as well as the opposite the surface of the head 12, e.g., for delivering the same active agent from a common supply or different active agents from separate supplies. In some embodiments, reservoir 15 may consists of one or more separate reservoirs that contain liquid media having different active agents.

In one construction, the cleaning elements 5 comprised hollow lumens or the like and the liquid medium having an active agent is delivered through the cleaning elements 5. The liquid medium may also be delivered simultaneously through outlets 50 located at different portions of the toothbrush 1, for example to aid in the application of the active agent to different areas of the mouth. Although reference is made to a plurality of outlets, it is contemplated that a single outlet could be used.

The switch for activating the pump 18 may be the button 22, as illustrated in FIG. 1, or it may be another type of switch such as a touch or heat sensitive type of switch, user-activated toggle switch, rotating dial. Engaging the button 22, such as, by depressing the button 22, may activate a timing circuit which causes the pump 18 to operate for a period of time which, in turn, causes a predetermined amount of the liquid medium containing the active agent to be pumped from the reservoir 15 and through the outlets 50. The pump 18 has a power source, such as a battery 21, which may be located in the handle portion 10. The timing circuit causes the pump 18 to operate for a time period which either may be preset or may be adjustable, for example, by using a slidable variable control, rotatable variable dial or digital preset control. The time interval also may vary depending on the active agent or the amount of time programmed by the user or manufacturer.

The liquid medium containing the active agent may be incorporated into a sealed reservoir 15 during manufacture of the toothbrush 1, in which case the toothbrush 1 may be disposed of after the supply of the active agent is exhausted. Alternatively, the reservoir 15 may be refillable through an inlet (not shown), or may be replaceable, e.g., by inserting a replaceable cartridge into a recess in the toothbrush. A replaceable reservoir 15 may provide the added benefit of allowing a user to use different active agents. A cartridge may be provided with a sharpened element which penetrates a membrane in the recess to permit the medium to flow from the cartridge. The cartridge may be spring-loaded to stay in place after insertion into the recess, and can have a seal to prevent unwanted leakage of the active agent. The cartridge may be disposable or refillable. Other methods of providing a refillable and/or replaceable cartridge or the like may be used.

The pump 18 may be coupled to the head 12 by various known methods including bonding, molding, melting, ultrasonic or heat welding, and mechanical fixing. The pump 18 can also be integrated into the head 12 to save space and cost by bonding/molding drive element directly in a cavity in the head. Alternatively, the pump 18 or the reservoir 15 may be coupled to a portion of the toothbrush 1 by similar means.

Referring to FIG. 1, reservoir 15 can be provided in a displaceable construction, such as a collapsible bag or container, connected to the micro piezoelectric pump 18 via a fluid pathway 19, such as a flexible tubing. The tubing can be embedded in the brush handle 10 or a channel directly molded in the brush handle 10. The reservoir 15, when provided as a collapsible bag or container, may be used so that air bubbles are not generated during transportation of active ingredients or agents and brushing. In addition, the collapsible bag or container ensures that negative pressure does not build up in the container as to reduce pumping rate after a portion of active ingredients or agents has been withdrawn by the micro piezoelectric pump 18. The collapsible bag or container can store enough material for about 60-120 uses, where each use will consume about 10-50 μL (micro-liters) of fluid or about 10-100 μL of fluid. Nevertheless, other values are possible.

Figure 3A:
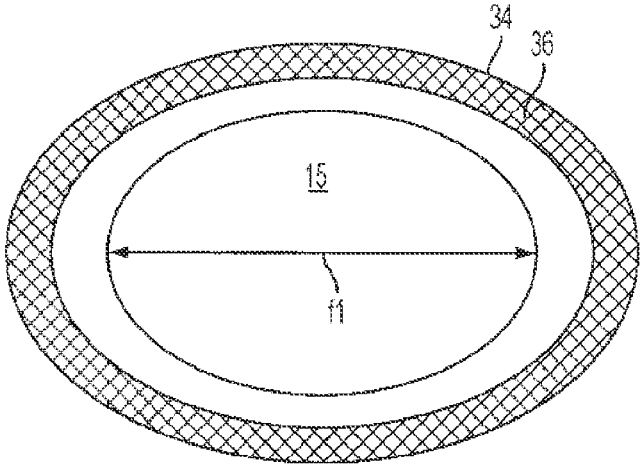
FIGS. 3A-3C are schematic cross-section views taken along line 3-3 in FIG. 1 showing a displacement of a reservoir as a liquid is withdrawn from the reservoir.
Figure 3B:
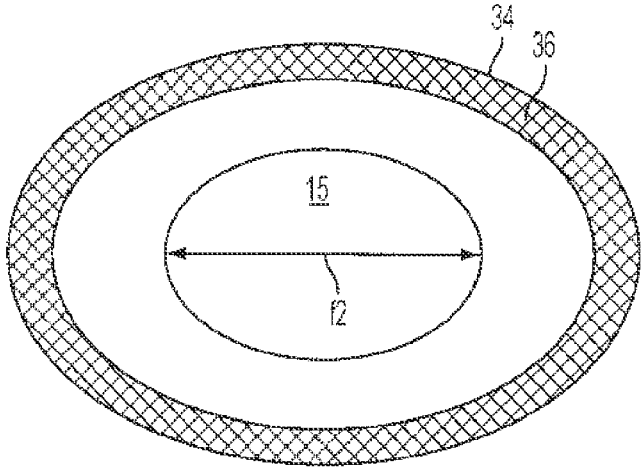
Figure 3C:
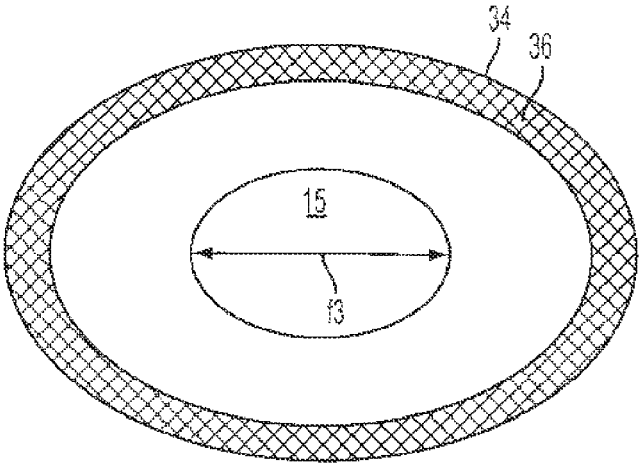

FIGS. 3A-3C show cross-sectional views of the toothbrush 1, taken along line 3-3 in FIG. 1. FIGS. 3A-3C show the radial displacement of the compressible reservoir 15 as liquid is depleted from the reservoir, with f1, f2, and f3 representing the width of the reservoir in FIGS. 3A, 3B, and 3C, respectively. The width as used here is one of the many ways that may be used to measure the radial displacement. The elements 34 and 36 represent the surface and thickness of the toothbrush body, respectively. As can be appreciated, as the pump 18 operates, negative pressure (e.g. suction pressure) is provided in the pathway 19 and the reservoir 15. As the liquid in the reservoir 15 is depleted by flowing to the head 12, the reservoir 15 is compressed to maintain fluid communication with the pump 18. For example, FIG. 3A shows a reservoir 15 with a width of f1 when the liquid is at a maximum. As the liquid is depleted by flowing to the toothbrush head portion 12 via the pathway 19 and pump 18, the width of reservoir 15 becomes smaller as shown in FIG. 3B, where f2 is less than f1. As the liquid is further depleted the reservoir 15 is compressed further as shown in FIG. 3C, having width f3, where f3 is less than f2. Hence, width f3 is less than width 12 and width f2 is less than width f1. Nevertheless, the reservoir 15 may become smaller in the longitudinal axial direction during operation of the pump 18. With respect to longitudinal displacement, the distal end of the reservoir 15 may displace in the direction of the head of the toothbrush.

The active agent may be delivered in a dose appropriate for its intended purpose. The amount may be controlled by controlling the duration the pump 18 operates after the button 22 is pressed. The duration of dispensation will depend on the desired dose and the flow rate of the medium, and typically ranges from about 1 second to 5 minutes, often from about 5 seconds to about 2 minutes, and may range from about 10 seconds to 30 seconds. The dispensing action may begin either immediately after the button 22 is pressed, or a predetermined delay may be programmed. It is contemplated that the button 22 may be controlled such that depending on the active agent being delivered, the duration of dispensation may be programmed accordingly.

Suitable devices are commercially available for delivering the medium from the reservoir 15 to the outlet(s) 50. The pump may deliver the medium through a variety of different actions that are mechanical, electrical, or a combination thereof, depending on the pump structure.

Figure 4:
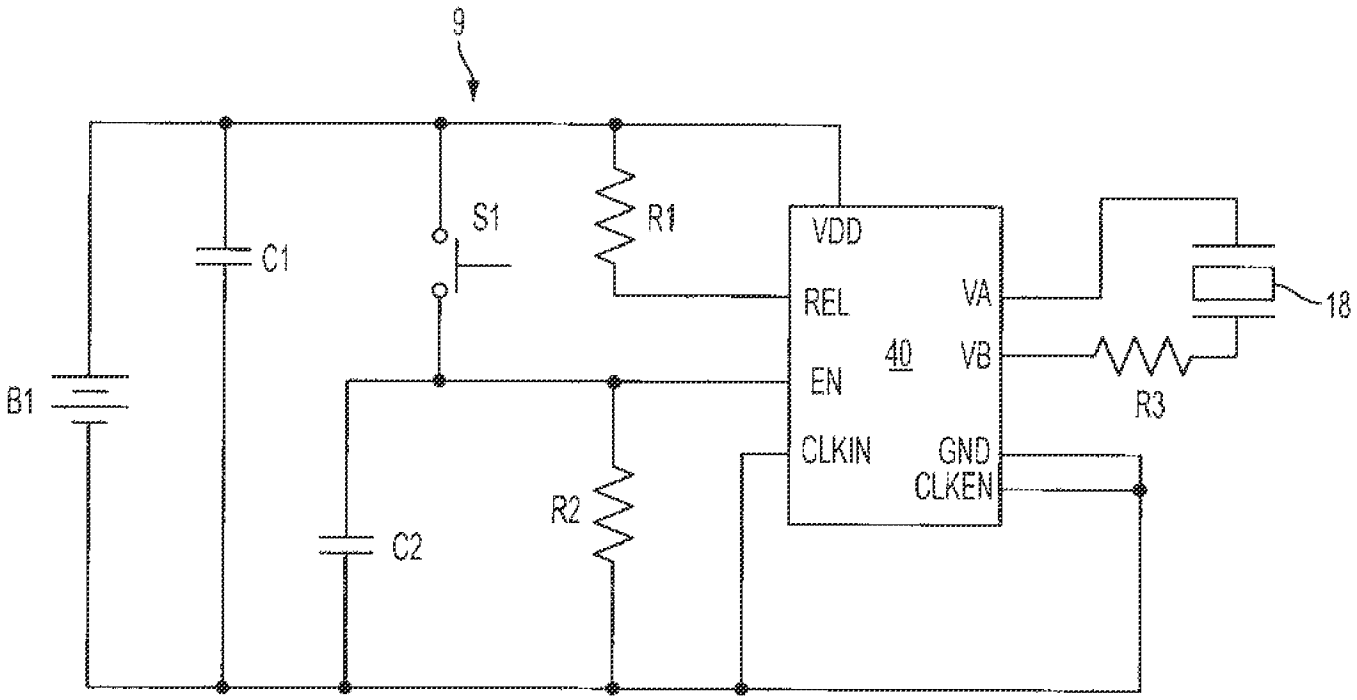
FIG. 4 illustrates a control circuit for operating a pump.

In one construction, as shown in FIG. 4, the micro piezoelectric pump 18 may be driven by a miniature circuit 9 that includes an integrated circuit (IC) driver 40. The miniature circuit 9 may further include, for example, resistors R1 and R2, capacitors C1 and C2, at least one switch S1, and a low voltage direct current (DC) source B1 (such as, a 1.5 volts or 3.0 volts battery) in order to power the driver 40. The driver, 40, such as, a Supertex HV 852 low noise and inductorless driver is a high voltage and low alternating current power source. The driver 40 converts the low voltage DC input from B1 to a high voltage alternating current (AC) output across the pump 18. For example, at 3.0 volts DC input, the driver 40 develops at least 150V peak-to-peak AC voltage, and draws around 23.8 mA-24 mA of current from the battery. At these values, the pumping rate for the micro piezoelectric pump 18 is around 10 μL/second for water at room temperature. The push button switch S1 is the trigger for timer when S1 is closed briefly the pump will run a predetermined time, and shut off itself based on the values of R2 and C2. The miniature circuit 9 can have a very low quiescent supply current of about 1 μA, obviating the need for a separate power switch to control the power when the pump is not in operation. The circuit including the driver 40 draws a current of about 30 mA when it is running for energy efficient operation. Nevertheless, other values are possible for the current. This particular drive circuit design produces modified trapezoidal waveform to drive the piezo actuator, nevertheless, many other types of waveforms are also suitable, such as sinusoidal and rectangular waveforms. It was understood that at the same peak-to-peak voltage and the same drive frequency, piezo pump driven by sinusoidal waveform produces less audio noise than the same driven by rectangular or trapezoidal waveforms, however sinusoidal waveform provides a lower pumping capacity.

The circuit can be provided on a conventional circuit board in various sizes. In one construction, the circuit board may measure around 8×13 $mm^2$ in size so that it can readily fit into the toothbrush handle 10.

Figure 5:
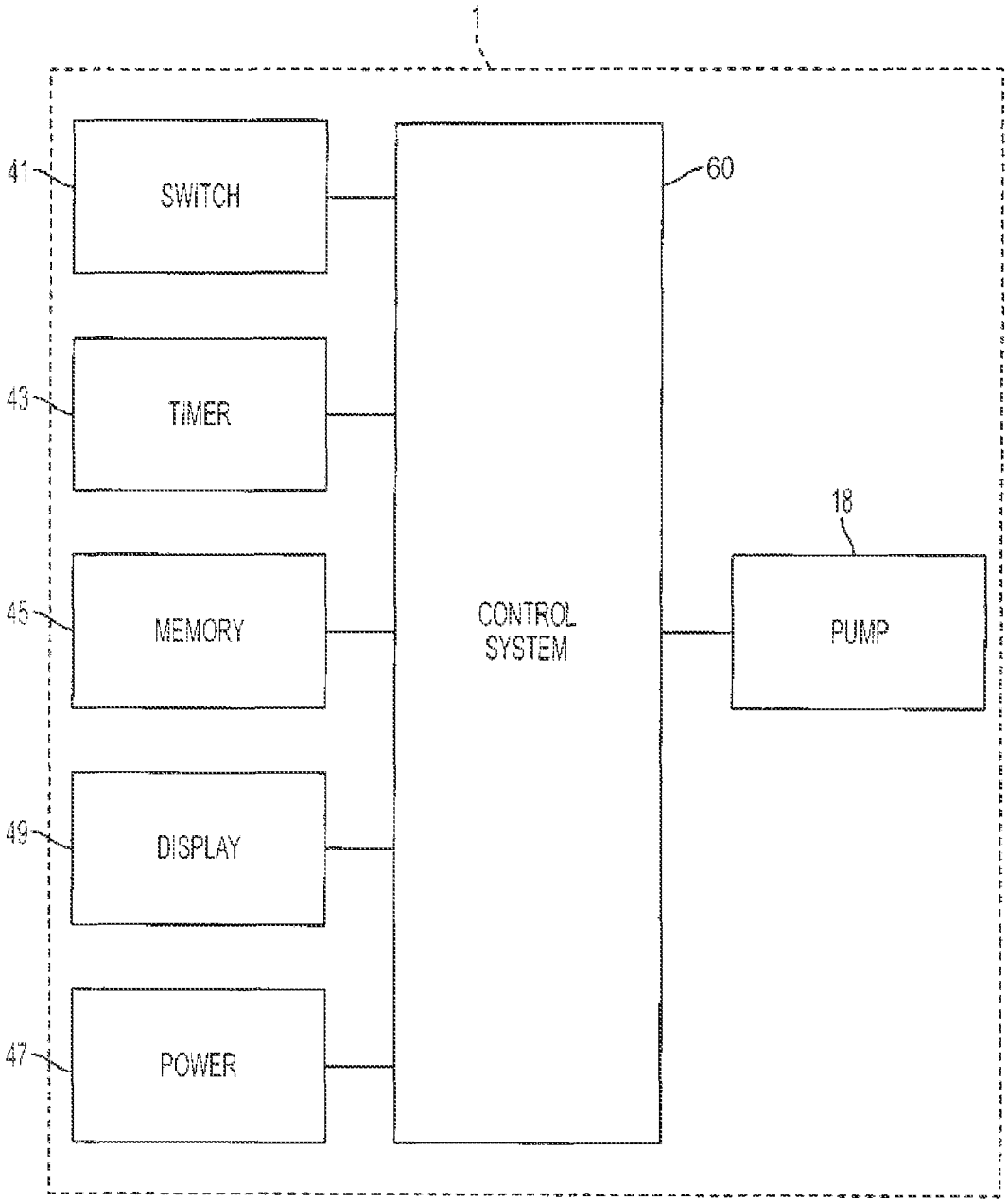
FIG. 5 is a functional block diagram of a control system for operating a pump.

Referring to FIG. 5, a control system 60, as an alternative to or in conjunction with one or more aspects of circuit 9 in FIG. 4, may be used to drive the piezoelectric pump 18 of the toothbrush 1. FIG. 5 illustrates a block diagram for one or more constructions of a control system 60 for driving the pump 18. One or more of the components shown in FIG. 5 may be included within one or more printed circuit boards.

The toothbrush 1 may include a control system 60, a power supply 47 operatively connected to one or more elements of the system 60, and a display 49 operatively connected to one or more components of the system 60. Power supply 47 may include one or more power components, such as a battery or a wired connection to a power source, providing for electrical power to electrical components of the toothbrush 1. The display 49 may display information, such as, switching time (activation or deactivation), pump rate, operating status/condition (e.g. off/on), remaining fluid volume in reservoir 15 when equipped with appropriate commercially available level sensors and level detection control circuitry), or other desired information. Display 49 may be any suitable electronic video display device having a size capable of being incorporated into toothbrush 1 including the handle 10, neck portion 11, or head 12. In some embodiments, display 49 may be an LED or LCD device with or without backlighting capabilities. In some embodiments, display 49 may include an audio component such that an audio segment may be played if desired. For example, a user may wish to use more than one active agent, in such instance, a message may be played that inform the user as to the different time periods that the different active agent should be used. The message may also inform the user when it may be time to switch to a different active agent.

In one or more constructions, the control system 60 may include a switch circuitry 41, a timer circuitry 43, and a memory 45. The control system 60 is operatively coupled to memory 45. Memory 45 stores data installed or programmed by the user. Memory 45 may be any programmable type in which nonvolatile storage can be electrically erased and reprogrammed. Possible alternatives include flash memory, flash ROM, RAM with battery backup. It should be understood that data formatted for toothbrush 1 may be downloaded to memory 45 or data may be preloaded in the memory.

Switch circuitry 41 may include hardware, software, computer-readable instructions, or other components to allow for activating or deactivating the operation of the piezoelectric pump 18. The switch circuitry 41 may be configured to perform the functions for processing signal(s) performing computer-readable instructions, and reading from and writing to a memory 45 associated with the toothbrush 1.

Timer circuitry 43 may include hardware, software, computer-readable instructions, or other components to allow for counting up or counting down time and for outputting such information (for example, switching time) in suitable form for use by the display 49. Timer circuitry 43 may include a crystal oscillator for counting seconds, minutes, etc. Timer circuitry 43 may be configured to perform the functions for processing signal(s) performing computer-readable instructions, and reading from and writing to a memory 45 associated with the toothbrush 1 operating in a timer mode.

The control system 60 may activate the pump 18 by a switch, 41 with a timer where the pump is turned OFF (that is, deactivated) automatically after a predetermined time. This activation switch, 41 may be controlled by a button 22 that may be located below the toothbrush neck 11 or elsewhere on the toothbrush 1, such as, between the toothbrush head 12 and handle 10. The duration of time that the pump is turned ON or activated may be adjusted as desired by the user.

The operation of the piezoelectric micro pump 18 is illustrated using FIGS. 6-12. In the exemplified embodiment, the piezoelectric pump is depicted as a low profile micro piezoelectric ("piezo") pump 18 having a more compact and thinner vertical profile by comparison. As further described herein, the low profile pump is advantageously facilitated by the integration of the inlet and outlet valves directly into the pump diaphragm or membrane structure itself as integral parts of the membrane. Accordingly, separate valve structures distinct from the membrane are not required. This beneficially further provides a mechanically simple pump design having less separate components which can be manufactured more easily and economically. In embodiments where the low profile piezo pump according to the present invention will be incorporated into a toothbrush, the efficient use of space can be readily accommodated into and molded as an integral part of an oval shaped toothbrush head. Therefore, in some embodiments, the piezo pump housing may be function as the toothbrush head itself which is configured and adapted for supporting a plurality of tooth cleaning elements 5. These aspects and advantages of the low profile piezo pump 18 will be evident from further description provided herein.

Referring now to FIGS. 7-10, low profile piezo pump 18 generally includes a pump housing 101 defining a pump chamber 135, inlet check or flap valve 137, discharge or outlet check or flap valve 139, and flexible diaphragm or membrane 133 with a piezo electric actuator 131 mounted thereon. In some embodiments, piezo actuator 131 may be made of any suitable commercially-available piezoelectric ceramic material such as those available from Omega Piezo Technologies of State College, Pa. or other suppliers. While actuator 131 is referred to as a piezoelectric actuator 131, it is understood that other actuator may be used as desired. Membrane 133 may be made of any suitable material including for example without limitation coated thin metal film (e.g. brass or steel) or other resiliently flexible polymeric material (such as polyacetate, polyethylene, polypropylene, polyethylene terephthalate, polystyrene, polyvinyl chloride, polycarbonate film) having an elastic memory so long as the material is capable of being elastically but non-permanently deformed by the piezo actuator 131.

Piezo pump 18, and more particularly piezo acutator 131, is connected to an electric power source via a pump drive system for operating the pump. In some embodiments, the pump drive system may be provided by driver circuit 9 and/or control system 60 previously described herein and shown in FIGS. 4 and 5, which are each connected to a power source. The power source may be a low voltage direct current DC source B1 (as shown in FIG. 4) such as a battery or a power supply 47 (as shown in FIG. 5) such as a battery or wired connection to a power source external to the toothbrush 1 which may be an AC house current supply converted via a transformer to lower voltage DC. The pump drive system is operative to provide a supply electric current and voltage to piezo actuator 131 for operating the piezo pump 18 in a conventional manner known to those skilled in the art, and already described above with reference to FIGS. 4 and 5 showing circuit 9 and control system 60. The pump drive system is preferably operable to supply voltage with alternating polarities in various forms to the piezo actuator 131 to induce the corresponding pumping motions of flexible membrane 133 as further described herein.

Pump housing 101 may be formed of any suitable material. Preferably, housing 101 is formed of a suitable polymeric or plastic material conventionally used in the art. Pump housing 101 may be fabricated by molding or other processes conventionally used in the art.

Figure 10:
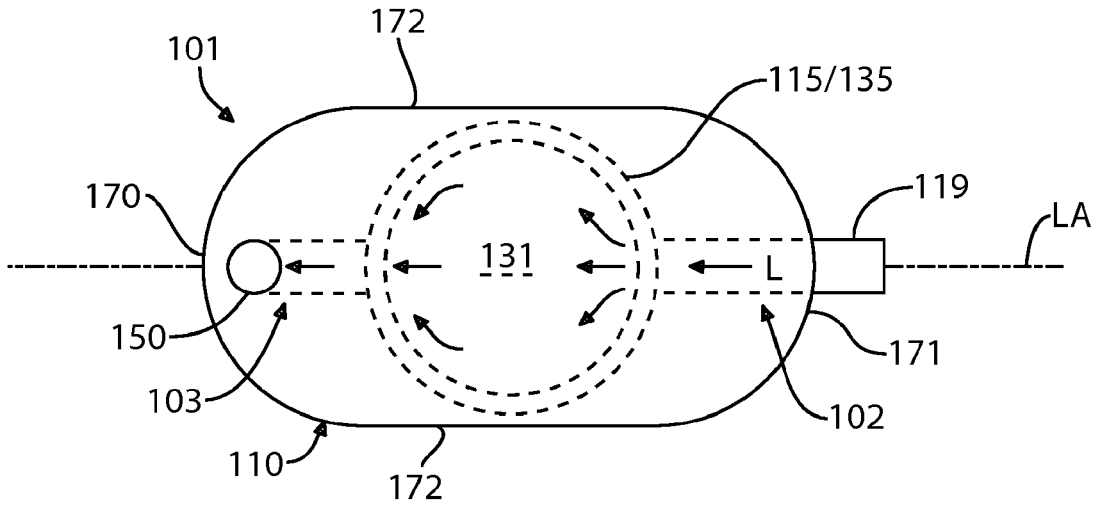
FIG. 10 is a top plan view of the pump housing of the foregoing low profile piezoelectric pump.
Figure 11:
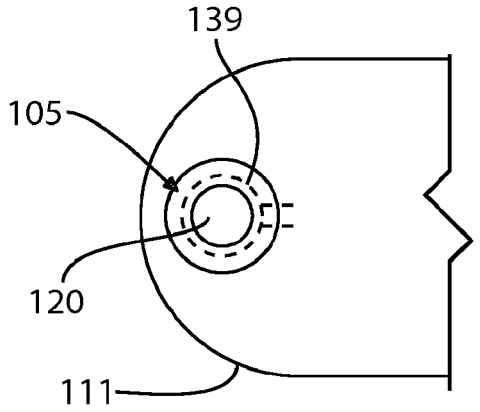
FIG. 11 is a partial top plan view of a forward section of a lower portion of the pump housing of FIG. 10 showing a valve seat.
Figure 12:
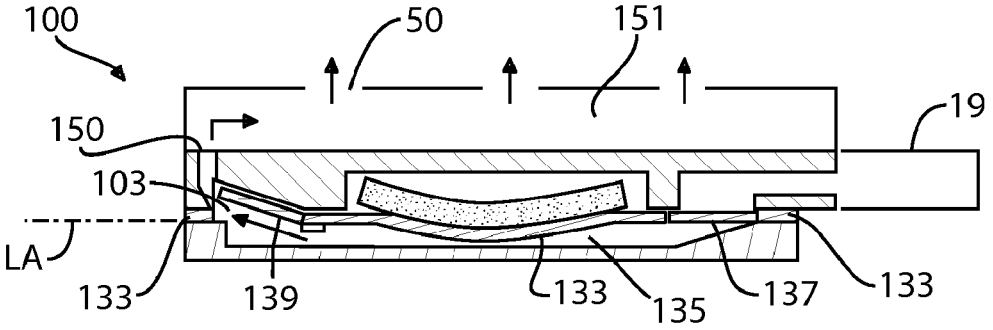
FIG. 12 is a side cross sectional view through the alternative low profile piezoelectric pump showing an outlet or discharge plenum disposed above the pump.
Figure 13:
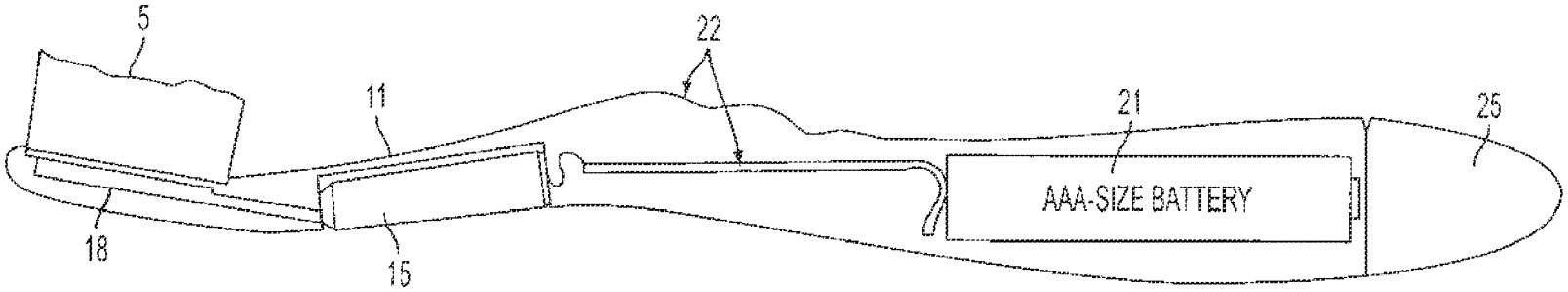
FIG. 13 is a side elevation view of an alternative toothbrush construction having a reservoir disposed in a neck portion.

FIG. 10 shows a top plan view of pump housing 101, the pump housing 101 defines a forward end 170, opposing rear end 171, two opposing lateral sides 172, and a longitudinal axis LA passing though ends 170, 171. Other aspects of pump housing 101 will be further described herein.

Figure 7:
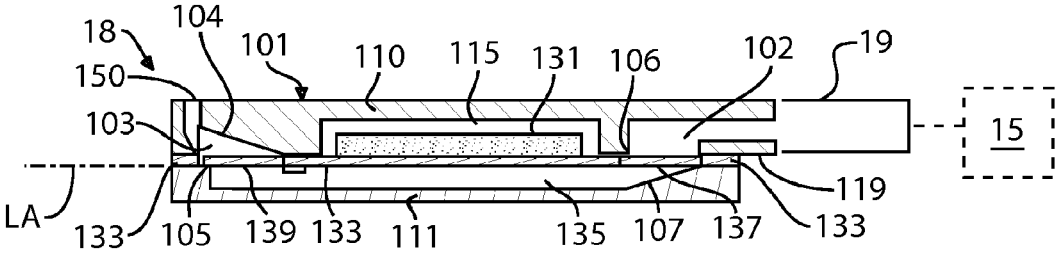
FIG. 7 is a side cross sectional view through the alternative low profile piezoelectric pump, with the flexible membrane of FIG. 6 in an "at rest" position.
Figure 8:
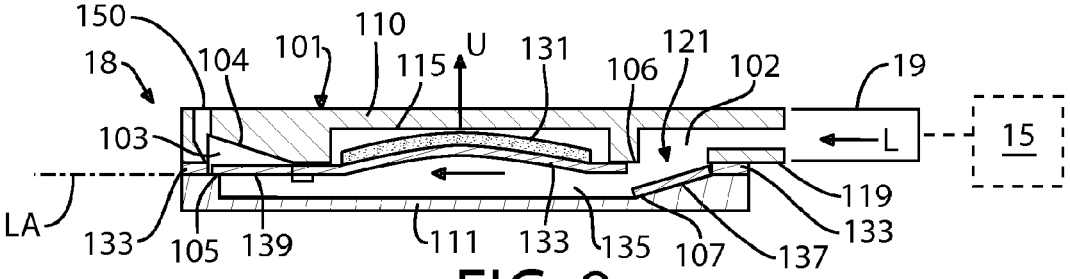
FIG. 8 is a side cross sectional view through the alternative low profile piezoelectric pump, with the flexible membrane of FIG. 6 in an "intake" position.
Figure 9:
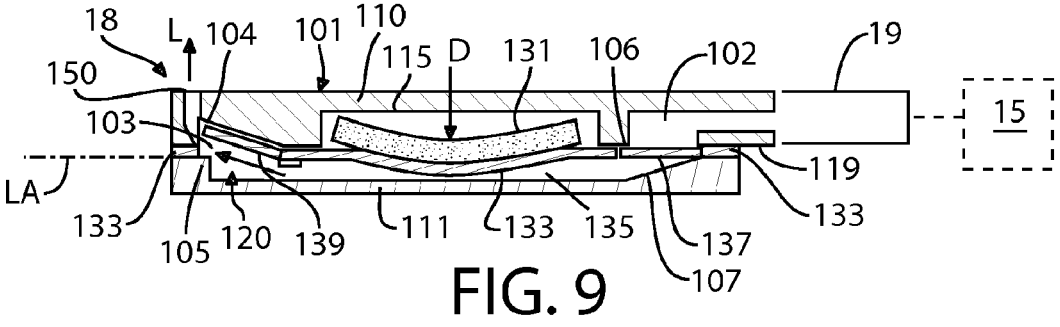
FIG. 9 is a side cross sectional view through the alternative low profile piezoelectric pump, with the flexible membrane of FIG. 6 in an "ouput" or "discharge" position.

Referring now to FIGS. 7-10, pump housing 101 further includes an upper portion 110 which is secured and mounted to lower portion 111 by any suitable means used in the art including bonding, molding, melting, ultrasonic or heat welding, adhesives, and mechanical fixing such as without limitation fasteners, snap or interference locking systems including pegs or tabs, etc. Preferably, pump housing 101 in one embodiment is configured such that flexible membrane 133 may be mounted in the housing by being retained between opposing sections of upper and lower portions 110, 111 after the two portions are assembled and secured together as shown in FIGS. 7-9. In an embodiment, a majority part of flexible membrane 133 is securely attached to both upper and lower pump bodies 110 and 111 to form air tight seals. Only two flap valves 137 and 139, and the central portion 114 of the flexible membrane 133 remains free, i.e. not attached to pump body 101. In this embodiment, a good seal is achieved between pump housings 110 and 111, and flexible membrane 133 to prevent leak. Also, in this embodiment, a good seal is maintained between upper pump housing 110 and flexible membrane 133 to prevent oral care fluid L entering upper pump chamber 115 so that contamination to oral care fluid L by piezoelectric actuator 131 can be avoided.

Figure 6:
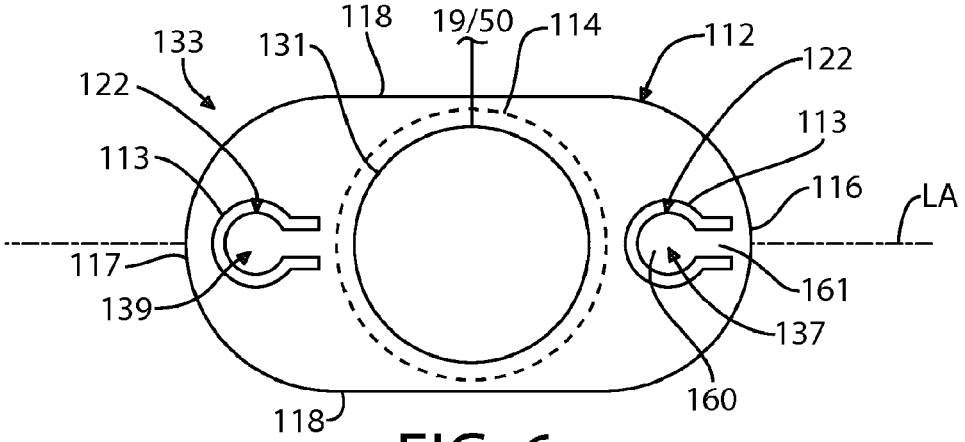
FIG. 6 is a top plan view of a flexible membrane for an embodiment of a low profile piezoelectric pump usable in a toothbrush construction, such as the toothbrush construction shown in FIG. 1.

Referring also now to FIG. 6, membrane 133 is preferably secured to housing 101 at or proximate to at least a portion of the peripheral edges 112 of the membrane in the vicinity of a central portion 114 of the membrane. The central portion 114 is proximate to the piezo actuator 131 between opposing ends 116, 117 and lateral sides 118 of the membrane. This ensures that the central portion 114 of membrane 133 on which actuator 131 is preferably mounted has sufficient freedom of movement to be deformed via the actuator for providing the full upward intake U and downward discharge D strokes of the -pump membrane during operation. This is generally illustrated in FIGS. 7-9. Other portions of membrane 133 lying beyond central portion 114 such as towards ends 116, 117 may be fixedly secured to housing 101 to remain stationary during pump operation, except for the portions of the membrane forming integral flap valves 137, 139 as further described herein. A recess 115 is formed in a central location of upper portion 110 of pump housing 101 for receiving actuator 131 therein. The recess 115 should not fluidly communicate with any part of pump chamber 135 which is positioned below the recess 115 and separated by flexible membrane 133 in some embodiments as shown in FIGS. 7-9 to avoid contamination to oral care fluid L by piezoelectric actuator 131.

Referring to FIGS. 7-10, pump housing 101 further includes an inlet port 102 and discharge or outlet port 103 which fluidly communicates with pump chamber 135 via the flow path through the pump 18. As shown in FIG. 10, recess 115 and pump chamber 135 (shown in dashed lines) are laterally and longitudinally enlarged in contrast to pump inlet and outlet ports 102, 103 and may have any suitable configuration in top plan or side view. Inlet port 102 may include a conventional outwardly projecting inlet tubing nipple or connector 119 configured for connection to a flow conduit such as tube 19 which in turn is fluidly coupled to reservoir 15. Piezo pump 18 takes suction and draws oral care fluid or fluid L from the reservoir 15 through tube 19 which is delivered to pump chamber 135 via inlet port 102. The inlet port 102, pump chamber 135, outlet port 103, and other flow conduits that may be provided therebetween in the pump housing 101 through which the oral care fluid L may flow define a continuous flow path through the pump (see FIG. 10).

One aspect of the low profile piezo pump 18 design is that the pump chamber 135 is formed as an integral part of the flow path through the pump, and not as a separate chamber. Therefore, pump chamber 135 may be formed from an enlarged portion of the flow path in pump housing 101 as shown in FIGS. 7-10 to conserve vertical space.

Pump housing 101 further defines a pair of valve seats associated with each of inlet valve 137 and outlet valve 139. Referring to FIGS. 7-9 and 11, pump housing 101 therefore defines an upper valve seat 104 and lower valve seat 105 disposed proximate to and in fluid communication with outlet port 103. Valve seats 104, 105 are configured to abuttingly contact and support outlet valve 139 in the open and closed positions. Similarly, pump housing 101 also defines an upper valve seat 106 and lower valve seat 107 disposed proximate to and in communication with inlet port 102 for serving the similar purposes for inlet valve 137.

Upper valve seat 104 and lower valve seat 107 may be similarly configured and formed by inclined surfaces of pump housing 101 against which valves 139, 137 become seated when these valves are each in their open positions (see FIGS. 8 and 9). The inclined surfaces, disposed at an angle to longitudinal axis LA, provide a smooth flow transition to and from pump chamber 135 via the inlet and outlet ports 102 and 103 to reduce turbulence and frictional pressure loss.

In some embodiments, upper valve seat 104 and lower valve seat 107 may preferably be at least coextensive in width with valves 139 and 137 respectively and form continuous flat but inclined surfaces behind each valve when open to provide full support against the suction or discharge pressure developed by piezo pump 18. Accordingly, in this embodiment, valve seats 104 and 107 may support the entirety of valves 139 and 137 respectively.

Referring to FIGS. 7-9 and 11, upper valve seat 106 associated with inlet valve 137 and lower valve seat 105 associated with outlet valve 139 may be annular in shape and define respective flow apertures 120, 121. Valve seats 105, 106 preferably seal only around the peripheral edges 122 of inlet and outlet valves 137 and 139 respectively. This is most clearly shown with respect to lower seat 105 in FIG. 11, which is a partial top or plan view of a front section of lower portion 111 of pump housing 101 showing lower valve seat 105 and the relative overlap position of outlet flap valve 139 on the valve seat shown in dashed lines. Upper valve seat 106 on a rear section of upper portion 110 of pump housing 101 has a similar arrangement, but is inverted in orientation (see, e.g. FIG. 8). This arrangement is necessitated by the fact that the flow apertures 120 and 121 define part of the flow path through the pump housing 101 and are in fluid communicate with pump chamber 135. In some embodiments, flow apertures 120, 121 may have a round or circular configuration owing to the annular shape of valve seats 105, 106 (see, e.g. FIG. 11) that respectively form circular-shaped flow apertures 120 and 121 respectively. In the embodiment shown in FIGS. 7-9, valves seats 105 and 106 may lie in a plane parallel to longitudinal axis LA and flexible membrane 133 since they engage flap valves 137, 139 formed in the membrane.

Although flow apertures 120 and 121 are circular or round in shape in the foregoing embodiments described, other suitable configurations may be provided.

In the embodiment shown in FIGS. 7-10, outlet port 103 discharges oral care fluid L via one or more discharge outlets 150 in housing 101. Discharge outlets 150 may have any suitable shape including without limitation round/circular, oval, rectangular or arcuately curved slots, other polygonal shapes, and combinations thereof. The discharge outlets 150 may include a short outlet tube or nipple in some embodiments similar to inlet tubing connector 119 described herein for connection to discharge tubing (not shown). Discharge outlets 150 may dispense oral care fluid L directly from toothbrush head 12 either into and through the field of the tooth cleaning elements 5 (for example, similar to outlets 50 shown in FIG. 2) and/or from other parts of the head beyond the tooth cleaning elements.

As shown in FIGS. 7-9, discharge outlet 150 may be oriented to dispense fluid L in a direction generally perpendicular to longitudinal axis LA of the pump 18. In other embodiments, however, fluid L may be discharged in a direction axially and/or laterally from housing 101 in a plane generally parallel to longitudinal axis LA. In other embodiments, outlet port 103 may discharge oral care fluid L into a larger tubing header or plenum or 151 (see FIG. 6) via discharge outlet 150 which in turn may be provided with one or more flow outlets 50 as previously described herein. Advantageously, this allows fluid L to be dispensed from the toothbrush head 12 in various directions and orientations as well as from multiple outlets 50. In some embodiments, the plenum 151 may preferably be disposed in the toothbrush head 12 beneath the tooth cleaning elements 5 and above pump housing 101. The plenum 151 may be molded integrally as part of the housing 101. In some embodiments where pump housing 101 may form the toothbrush head 12, a plurality of tooth cleaning elements 5 may be mounted to the plenum 151 (not shown).

Referring initially to FIG. 6, inlet and outlet flap valves 137, 139 function as backflow-preventing check valves and permit flow though pump 18 in a single direction from inlet port 102 to outlet port 103. For example, in the intake position, valves 137, 139 cooperate to allow liquid to flow into the pump chamber 135. During liquid intake, the inlet valve 137 is in the open position while the outlet valve 139 is in the closed position. For another example, in the discharge position, valves 137, 139 cooperate to allow liquid to exit from the pump chamber 135. During liquid discharge, the inlet valve 137 is in the closed position while the outlet valve 139 is in the open position. Flap valves 137, 139 are preferably positioned in inlet port 102 and outlet port 103 respectively and are operative to seal or close off these inlet and outlet ports as further described herein.

Referring to FIGS. 6-9, in one preferred embodiment, flap valves 137, 139 are formed from flexible membrane 133 itself as an integral part thereof to conserve vertical space within pump housing 101, thereby permitting a low profile and compact piezo pump 18 design to be provided. Separate or discrete flap valves that would each require individual fabrication and subsequent mounting in the pump housing are thus avoided. Beneficially, this is translates into a mechanically simpler design resulting in a pump which can be assembled in less time and at a lower cost by eliminating some manufacturing steps and components.

With continuing reference to FIG. 6, inlet and outlet flap valves 137, 139 may be formed as flexible cantilevered members or tabs which are cut or otherwise formed to shape in membrane 133 by any suitable means used in the art such as laser or mechanical cutting, stamping, etc. In one possible embodiment shown, flap valves 137, 139 may each be formed by generally C-shaped cutouts 113 in membrane 133 and include an enlarged seating portion 160 having a first width and narrower adjoining hinged portion 161 having a second width less than the first width. Hinged portion 161 integrally connects the seating portion 160 to the larger main body portion of membrane 133, thereby forming a flexible connection to the main body of the membrane. The flexibility of flap valves 137, 139 is enhanced by the narrower width of hinged portion 161 thereby providing greater freedom of movement and responsiveness of the sealing portion 160 when moving between open and closed positions as further described herein. The preferably narrow cutout 113 in membrane 133 forming each of flap valves 137, 139 provides a small clearance or gap between the valve and membrane body. This ensures that the flap valve can move and operate freely without binding to the main body of the membrane 133. The cutout therefore preferably may conform generally to the shape of the flap valves 137, 139.

Referring to FIGS. 6-9, sealing portion 160 preferably conforms in general to the shape of valve seats 105, 106 and corresponding flow apertures 120, 121 to effectively seal the apertures. In the embodiment shown, flow apertures 120, 121 may have a circular or round shape when seen in plan view from above along the axis of the apertures. Sealing portion 160 of flap valves 137, 139 have a correspondingly circular or round shape in plan view as shown in FIG. 6. It will be appreciated that other suitable shapes for both sealing portion 160 and hinged portion 161 of flap valves 137, 139 are possible and contemplated depending on the shape selected for flow apertures 120, 121 so long as the sealing portion is capable of providing a good seal around the flow apertures with minimal or no leakage. In addition, although hinged portion 161 of flap valves 137, 139 is preferably narrower in width than sealing portion 160, some embodiments such as if the valves are configured as flexible rectangular tabs may have an equal width for both the sealing and hinged portions. Accordingly, the shape of flap valves 137, 139 is expressly not limited to the preferred configuration described and shown herein in the figures.

Referring to FIGS. 6-9 flap valves 137, 139 may be axially aligned with longitudinal axis LA of pump housing 101 to facilitate the provision of curved ends and minimize the width of the flexible membrane 133 required. Flexible membrane 133 is preferably thin with flat opposing upper and lower surfaces to optimize the flexibility of the membrane for elastic deformation. As best shown in FIGS. 7-9, flap valves 137, 139 are disposed and lie within a horizontal reference plane defined by the flat flexible membrane 133 since the valves 137, 139 are formed from integral parts of the membrane itself. It is contemplated that flap valves 137, 139 may be disposed and lie within the horizontal reference plane defined by the flat flexible membrane 133 in embodiments where the vales 137, 139 are not formed from integral parts of the member 133 itself. This permits the pump 18 to have as low a profile or height as possible for incorporating the pump into a toothbrush head 12 without unduly increasing the size of the head necessary to accommodate the pump.

FIG. 10 shows a top or plan view of one possible configuration of pump housing 101. In this embodiment, pump housing 101 may have an elongated configuration generally approximating an oval or rectangle with arcuately curved opposing ends to conform readily to the shape of a common toothbrush head (see, e.g. FIGS. 6 and 10). In some embodiments, pump 18 forms the toothbrush head itself where pump housing 101 may be integrally molded with neck portion 11 and handle 10 during a single molding operation. In such an embodiment, tooth cleaning elements 5 (as shown in FIG. 2) may be mounted to and supported by upper portion 110 of pump housing 101. In other embodiments, pump housing 101 may be molded as a separate unit which can be inserted and assembled into a cavity provided in toothbrush head 12 as previously described herein.

Operation of low profile piezo pump 18 will now be described. Referring to FIG. 7, pump 18 is shown with flexible membrane 133 in an "at rest" or neutral position being undeformed and straight/flat (i.e. its normal configuration). Inlet and outlet flap valves 137, 139 are each in a closed position being seat against valve seats 106 and 105, respectively. Because there is no positive or negative pressure being produced by the pump, flap valves 137, 139 remain aligned within the horizontal reference plane defined by membrane 133. Piezo actuator 131 is electrically connected to driver circuit 9 and/or control system 60 as shown in FIG. 6 and ready for operation.

FIG. 8 shows pump 18 during an upward intake stroke U of the pump. A voltage is applied by the pump driver circuit 9 and/or control system 60 to piezo actuator 131 which changes shape and in turn causes flexible membrane 133 to non-permanently deform and bow or move upward assuming an upwardly concave shape with respect to pump chamber 135 as shown. Because flexible membrane 133 forms a top wall of pump chamber 135, movement of the membrane increases the volume of the pump chamber and concomitantly creates a temporary negative pressure or vacuum within the pump. As shown by the directional flow arrows, oral care fluid L is sucked or drawn into pump chamber 135 via the negative pressure or vacuum from reservoir 15 via tubing 19. The fluid L flows through inlet valve 137 which is drawn downwards and forced into an open position seated against valve seat 107 by the negative pressure and incoming flow. Outlet flap valve 139 remains seated in a closed positions being drawings tightly downward against annular valve seat 105 by the negative pressure. The inflow of oral care fluid L fills chamber 135 to a predetermined volume.

FIG. 9 shows pump 18 during a downward discharge stroke D of the pump. The polarity of voltage is reversed to piezo actuator 131 by the pump driver circuit 9 and/or control system 60 which changes shape and causes flexible membrane 133 in turn to non-permanently deform and bow or move downward assuming a downwardly convex shape with respect to pump chamber 135 as shown. This downward movement of the membrane decreases the volume of the pump chamber 135 and concomitantly creates a positive pressure within the pump 18. As shown by the directional flow arrows, oral care fluid L is forced forward out from pump chamber 135 through outlet port 103. Fluid L flows through outlet flap valve 139 which opens and becomes unseated from lower annular valve seat 105 and is forced against upper valve seat 104 by the pressure and flow. With outlet flap valve 139 now in an open position, fluid L continues to flow through outlet port 103 and exits pump housing 101 via one or more discharge outlets 150 to be dispensed via the toothbrush head 12 (see, e.g. FIG. 2). The inlet valve 137 is forced upwards into a closed position seated against upper valve seat 106 by the positive pressure. This prevents fluid L from backflowing to the reservoir though the inlet port 102 of pump 18.

By using the pump driver circuit 9 and/or control system 60 to rapidly successively alternate the polarity of voltage to piezo pump 18 in the foregoing manner, an intake/discharge pumping cycle is created which can be performed between 10 to 5,000 times per second for delivering a predetermined flow rate or quantity of an oral care fluid L from reservoir 15 to a user from the toothbrush 1. It is well within the ambit of those skilled in the art to adjust the design parameters and electronic/electric pump driver circuitry and/or control system without undue experimentation to deliver the desired amount and pressure of oral care fluid.

Although one preferred location for providing a low profile piezo pump according to the present invention is in the toothbrush head as described herein, it will be appreciated that the pump may alternatively be disposed in the handle or neck portions of the toothbrush. In addition, multiple low profile piezo pumps may be provided which may be arranged in parallel to increase the quantity of oral care fluid dispensed, or the pumps may be arranged in series to increase the dispensing pressure of the liquid.

The foregoing process is repeated rapidly at 10-5000 times each second and is powered by the pump driver in circuit 9 and/or control system 60 which alternates the polarity of driving voltage to the piezo actuator 131, thereby providing the pump's 18 intake and discharge strokes for pumping fluid from the reservoir through outlets 50. The frequency of drive circuit can be easily altered by changing the value of resister R1 as shown in FIG. 4 to optimize the pumping rate for different physical configurations of the pump body or the properties of the oral care fluid L, such as vis In one construction, a kit includes a toothbrush and at least one cartridge containing an active agent. A user may select among multiple cartridges for a desired treatment. If the active agents have different intervals of application, the toothbrush may be provided with a feature, for example, a dial or a slider to vary the value of resistor R2 in FIG. 4, to enable the user to select the appropriate setting. Similarly, a single cartridge can come pre-loaded with multiple active agents in multiple chambers that may be selectively accessed and delivered by a switch, a valve or the like. The kit can also include a dentifrice if desired.

FIGS. 13-17 show a toothbrush construction in which the reservoir 15 is positioned at the bottom of the neck portion 11. A relatively short (e.g., about 10-20 mm) channel connects the reservoir 15 to pump inlet(s) located in the head portion.

Advantageously, by locating the reservoir 15 in the neck portion 11, the distance that the medium is dispensed to the head is minimized. In this way the implement is less prone to clogging, the required volume of the reservoir 15 may be reduced, or the reservoir 15 may be more easily replaced for changing or replenishment of the active agent.

Figure 14:
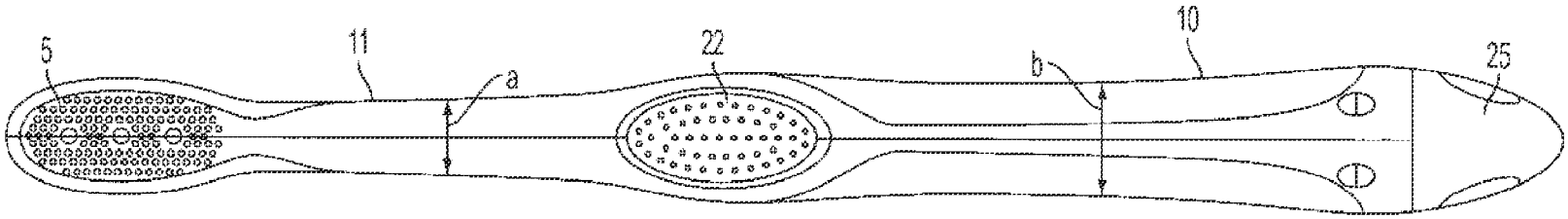
FIG. 14 is a top plan view of the toothbrush of FIG. 13.

With reference to FIG. 14, the cross-sectional area denoted in the "b" dimension of the handle portion 10 may be suitably selected to provide sufficient storage space for the battery 21, such as an AAA type or other generally cylindrical battery or rechargeable battery, while also providing ergonomic characteristics to permit easy gripping and manipulating of the toothbrush. The neck portion 11 has a cross-sectional area denoted in the "a" dimension which is generally less than that of the handle portion 10 and may be suitably selected to provide sufficient storage space for the reservoir 15. Either or both of the neck portion 11 and handle portion 10 may have contours such that the respective cross sectional area ("a" and/or "b") is non-uniform. Given these considerations, the ratio of the average cross-sectional area of the handle portion "b" to the average cross-sectional area of the neck portion "a" usually satisfies the relationship $1<b/a\leq 5$, (e.g., the ratio of b over a is greater than one and less than or equal to five) and often $1.2\leq b/a\leq 4$ (e.g, ratio of b over a is greater than 1.2 and less than or equal to four). Nevertheless, other values of the ratio are possible.

Figure 15:
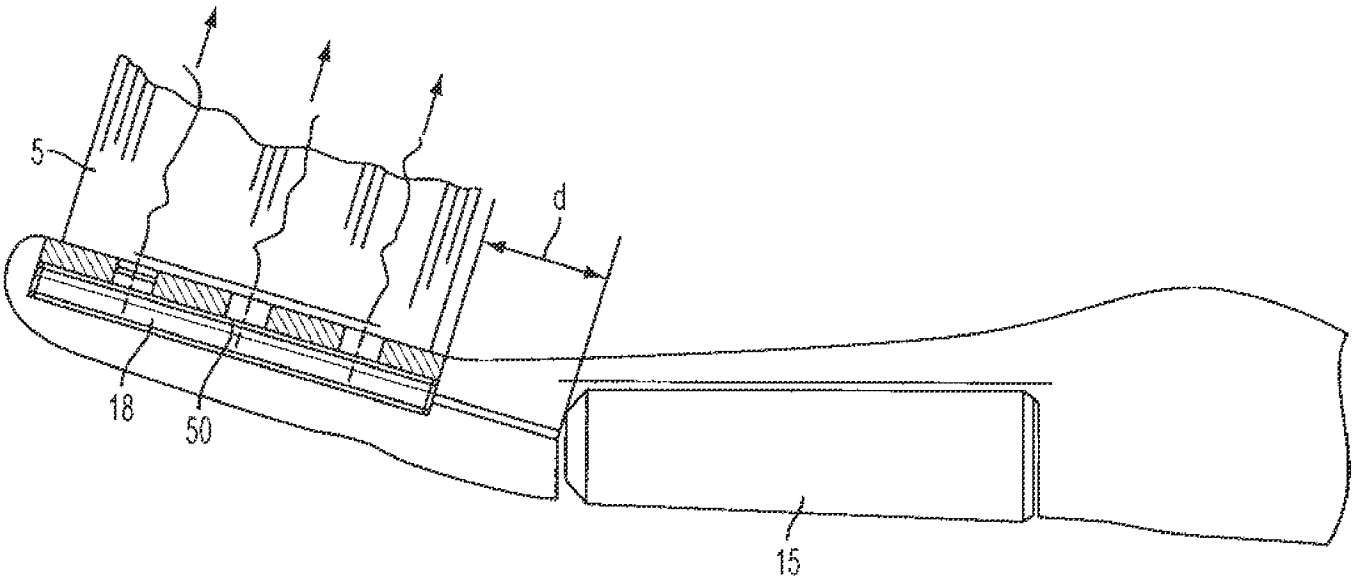
FIG. 15 is a side elevation view of a toothbrush having a piezoelectric pump in the head portion with a reservoir in a neck portion.

Referring to FIG. 15, micro piezoelectric pump 18 is positioned beneath the bristles 5 in the toothbrush head. Upon activation of the switch 22, the pump 18 draws a quantity of the medium from the reservoir 15 through a channel toward the head. The length of the channel (d) may range, for example, from about 10 to 20 mm. The medium is delivered through one or more outlets and through the bristles 5 as indicated by the arrows in FIG. 9.

Figure 16:
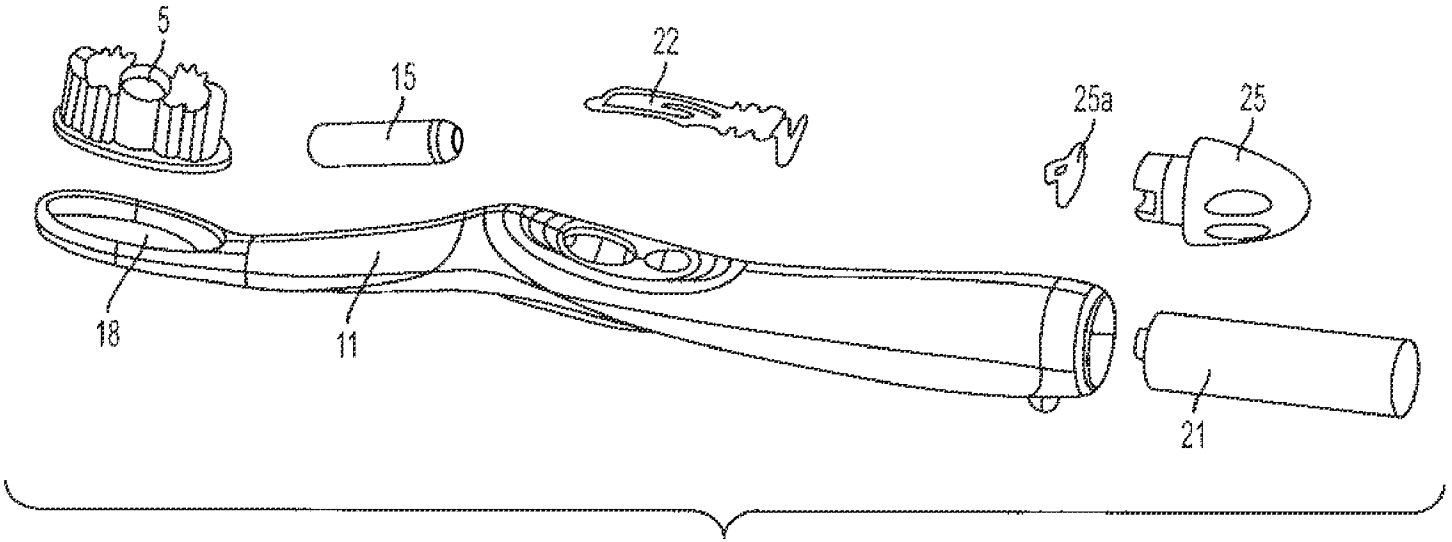
FIG. 16 is an exploded view of the toothbrush of FIG. 12.

FIG. 16 is an exploded view showing the various components of the toothbrush of FIG. 15. A metal battery contact **25*a* is coupled to the end cap 25 which encloses the battery 21. The neck section 11 houses the reservoir 15**.

The toothbrush 1 optionally may be provided with compartments and/or access panels for access to the various components, such as the power source and reservoir. The power source may be, for example, a replaceable or rechargeable battery.

Optionally, a user-activated switch, such as a dial (not shown), can have multiple settings for selecting one of several active agents. For example, the dial can have a first setting for oxidizer/whitener treatment, a second setting for breath freshener treatment, and a third setting for antimicrobial treatment. The dial setting instructs the timing circuit to activate the pump 18 for a time interval appropriate for the selected active agent. In an embodiment, a valve (not shown) may selectively connect the pump 18 to different chambers containing different active agents. In another embodiment, multiple pumps may be connected to different chambers containing different active agents. A controller may be used with either embodiments to direct the pump 18 or the multiple pumps to dispense the different active agents.

Figure 17:
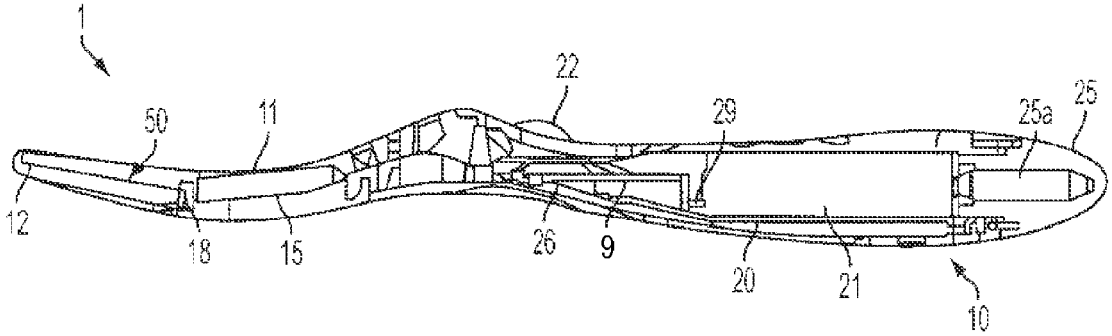
FIG. 17 is a side elevational view of an alternative toothbrush construction with the pump located next to the head and the reservoir in the neck.

As illustrated in FIG. 17, the handle 10 may include a sheath or sleeve 20 which extends in the longitudinal direction of the handle 10 and is made of electrically conductive material. Both the handle 10 and the sleeve 20 are open to the rear, thus forming a cavity which can be closed from the rear by a threaded closure part 25. The battery 21 may be a commercially available, non-rechargeable cylindrical battery, with a defined power, e.g. 1.5 V. Alternatively, one or more button cells or rechargeable storage battery could be used as a power source.

A spring contact 29 for the positive pole of the battery 21 is fitted in the sleeve 20, on a transverse wall, and is connected to the drive circuit 9 via an electric line 26. The electrical connection can be interrupted by means of the switch 22.

The closure part 25 may be provided with a threaded stub 25*a* made of an electrically conductive material and can be screwed into the handle 1 and/or into the sleeve 20. The threaded stub 25*a* may be provided with a contact surface which, with the closure part 25 screwed in, comes into abutment against the negative pole of the battery 21 inserted into the sleeve 20. The negative pole is electrically connected to the drive circuit 9 via the threaded stub 25*a*, the sleeve 20 itself. Instead of being transmitted via the electrically conductive sleeve 20, it would also be possible for the power from the negative pole to be transmitted in some other way, for example using wires or an electrically conductive plastic.

The toothbrush 1 may be used by applying toothpaste to the bristles and brushing the teeth in a conventional manner. The active agent may be administered by activating the switch, e.g., depressing button 22, to activate the pump 18, which causes the medium containing the active agent to be delivered though the outlet(s). The switch may instruct the timing circuit to activate the pump 18 for a predetermined time, which in turn dispenses the active agent in a predetermined amount. Alternatively, the active agent may be administered in a user-defined amount, for example, dispensation may occur for the duration that the button 22 is depressed. The active agent may then be applied to the teeth using the bristles. The active agent may be administered before, during, or after brushing.

In the toothbrush constructions described herein, the active agent itself may be contained in the reservoir 15. In other words, it is not necessary to generate the active agent internally or in situ. This simplifies the construction of the toothbrush and avoids the need to handle any byproducts associated with the synthesis of the active agent. Alternatively, an agent in one reservoir may be delivered via a delivery device to another reservoir where it is "activated," where it is then delivered via another delivery device to the one or more outlets. A delivery system in the toothbrush constructions may employ multiple connections that are direct or indirect.

Non-limiting examples of active agents which can be used include antibacterial agents, such as chlorhexidine, cetyl pyridininum chloride, triclosan, stannous compounds, zinc compounds and herbal extracts; oxidative or whitening agents, such as hydrogen peroxide, urea peroxide, sodium percarbonate, and PVP-$H_2O_2$; supercharged fluoride delivery ingredients (such as dicalcium phosphate dihydrate and others disclosed in U.S. Pat. No. 5,785,956); tooth sensitivity ingredients, such as $KNO_3$; occluding agents, such as Novamin® bioactive glass, sodium silicate, and arginine salts such as arginine bicarbonate; gum health actives, including those which reduce inflammation pathways and/or interfere in bacterial processes which produce inflammatory stimuli, such as polyphenols (such as baicalin and catechin), herbal extracts and triclosan; nutritional type ingredients, such as vitamins, minerals, amino acids, vitamin E, and folic acid; tartar control or anti-stain ingredients, including phosphate salts, polyphosphates, polyvinylphosphonic acid, PVM/MA copolymer; enzymes, such as those used for plaque disruption; sensate ingredients, such as those providing cooling, tingle, or heat sensations; flavors and flavor ingredients; anti-cavity or enamel repair agents; breath freshening ingredients; oral malodor reducing agents; anti-attachment agents, such as ethyl lauroyl arginate and silicone polymers; diagnostic solutions, such as plaque-indicator dyes; colorants or other aesthetic agents; and combinations thereof. Examples of flavors and flavor ingredients include essential oils, menthol, carvone, and anethole, and various flavoring aldehydes, esters, and alcohols. Examples of essential oils include oils of spearmint, peppermint, wintergreen, sassafras, clove, sage, eucalyptus, marjoram, cinnamon, lemon, lime, grapefruit, and orange.

The active agent and/or its medium can be selected to complement a toothpaste formula, such as by coordinating flavors, colors, aesthetics, or active ingredients. A flavor can be administered to create a gradual flavor change during brushing, which presently is not possible using toothpaste alone.

The active agent may be compatible with toothpaste, or may be unstable and/or reactive with typical toothpaste ingredients. Non-limiting examples of components which tend to be unstable and/or reactive with typical toothpaste ingredients include hydrogen peroxide, sodium fluoride, various calcium salts, chlorhexidiene, cetyl pyridinium chloride, ethyl lauroyl arginate, silicone polymers, and enzymes. The active agent also may be a tooth cleaning agent to boost the overall efficacy of brushing. Such tooth cleaning agents may or may not be compatible with the toothpaste ingredients.

The active agent can be provided in any suitable vehicle, such as in aqueous solution or in the form of gel or paste. In one example of an implementation, oxygen can aid in oxidation processes such as tooth whitening or air to enhance whole mouth flavor sensation. The use of air can increase the rate of diffusion of the flavor in the mouth. Non-limiting examples of vehicles include water, monohydric alcohols such as ethanol, poly(ethylene oxides) such as polyethylene glycols such as PEG 2M, 5M, 7M, 14M, 23M, 45M, and 90M available from Union Carbide, carboxymethylene polymers such as Carbopol® 934 and 974 available from B.F. Goodrich, and combinations thereof. The selection of a suitable vehicle will be apparent to persons skilled in the art depending on such factors as the properties of the active agent and the desired properties of the medium, such as viscosity. For example, the pump 18 may be used for dispensing a medium that has a viscosity of about 1 to about 200 cps.

The quantity of the medium dispensed may vary over a wide range depending on such factors as the identity of the active agent and its concentration in the medium. The quantity usually ranges from about 1 to about 500 μL per use, more usually from about 10 to about 100 μL. For example, the pump 18 may be configured to deliver 10 μL of 20% cetylpyridinium chloride gel over a period of 30 seconds, e.g., for application during the first 30 seconds of brushing the teeth. An advantage of this delivery is that ingredients incompatible with the toothpaste are exposed to the toothpaste as little as possible.

The reservoir 15 may contain a quantity of the active agent medium intended for a single use or a small number of uses, or may facilitate repeated use over an extended period of time, e.g., up to several months or several years (if used with a toothbrush having a replaceable head for example). The size of the reservoir 15 may be selected to be compatible with the desired overall dimensions of the toothbrush 1, particularly the neck portion 11, as well as such factors as the stability of the active agent and the quantity of medium administered during each application.

The supply of active agent in the reservoir 15 may be free or substantially free of components which are incompatible with the active agent and/or the medium containing the active agent, such as incompatible toothpaste components as previously identified. In one aspect, the reservoir 15 may be free or substantially free of toothpaste, as toothpaste is separately applied to the bristles by the user. Alternatively as noted above, an active agent may be originally retained in one reservoir and then transferred to another reservoir where it is activated just prior to delivery, which may be useful in certain conditions or circumstances.

As described in the present disclosure, pump 18 may have a compact construction that is suitable for incorporation into small spaces such as, without limitation, the head of toothbrush 1. Certain existing pumps include a pump chamber that is vertically stacked above flap valves and not axially aligned with but asymmetrically disposed with respect to inlet and outlet of the pump body or housing. In these pumps, the valves and the pump membrane may be separate components. Although this design may be generally compact in size, this arrangement may result in a vertical height and pump size which may not be ideal for all intended applications depending on the size and configuration of the oral care device into which the pump will be fitted.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

While the foregoing description and drawings represent preferred or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. A liquid dispensing toothbrush comprising:

a head supporting a plurality of tooth cleaning elements;

a reservoir disposed in the toothbrush for storing an oral care fluid;

at least one liquid dispensing outlet disposed in the head;

a pump disposed in the toothbrush, the pump being in fluid communication with the reservoir and the liquid outlet, the pump including a flexible membrane operable to pump the oral care fluid;

the membrane movable between alternating intake and discharge positions; and an inlet flap valve and an outlet flap valve disposed in the pump, wherein the inlet and outlet flap valves are formed as an integral part of the flexible membrane.

2. The toothbrush of claim 1, further including an actuator coupled to the membrane, the actuator being operable to move the membrane between alternating intake and discharge positions.

3. The toothbrush of claim 1, wherein the flap valves are formed as cantilevered tabs in the flexible membrane.

4. The toothbrush of claim 1, further comprising a pump drive system including a power source that is electrically connected to the actuator for operating the pump.

5. The toothbrush of claim 1, further comprising a handle supporting a neck coupled to the head, wherein the reservoir being disposed in one of: the head, the neck, or the handle, and the pump being disposed in one of: the head, the neck, or the handle.

6. The toothbrush of claim 1, wherein the reservoir is a collapsible flexible container operable to collapse upon withdrawal of the oral care fluid from the reservoir.

7. The toothbrush of claim 6, wherein a portion of the reservoir is radially displaceable, longitudinally displaceable, or radially and longitudinally displaceable.

8. The toothbrush of claim 1, further comprising a flow tube fluidly coupling the reservoir to the pump.

9. The toothbrush of claim 1, wherein the flexible membrane is mounted between opposing upper and lower portions of a pump housing which are separable components prior to assembly of the pump.

10. The toothbrush of claim 9, wherein the flexible membrane is positioned between the upper and lower portions of the pump housing for securing the membrane in the housing.

11. The toothbrush of claim 1, further including a circuit having a self timer so that upon activating the pump, the pump deactivates at a predetermined set time.

12. The toothbrush of claim 1, wherein the outlet comprises a plurality of outlets disposed in the vicinity of the tooth cleaning elements.

13. The toothbrush of claim 1, wherein the pump forms the head.

14. A liquid dispensing toothbrush comprising:

a head supporting a plurality of tooth cleaning elements;

a reservoir disposed in the toothbrush for storing an oral care fluid;

at least one liquid outlet disposed in the head;

a pump disposed in the head, the pump being in fluid communication with the reservoir and the liquid outlet, the pump including a housing defining a pump chamber and a flexible membrane operable to pump the oral care fluid, the membrane having a generally thin flat structure defining a membrane reference plane;

an actuator coupled to the membrane and operable to move the membrane between alternating intake and discharge positions; and an inlet flap valve and an outlet flap valve disposed in the pump, the flap valves being positioned to lie in the membrane reference plane.

15. The toothbrush of claim 14, wherein the inlet and outlet valves are formed as an integral part of the flexible membrane.

16. The toothbrush of claim 14, wherein the flexible membrane is mounted between opposing upper and lower portions of a pump housing which are separable components prior to assembly of the pump.

17. The toothbrush of claim 14, further comprising a power source electrically connected to the actuator, the power source operable to vary a supply voltage to the actuator for moving the membrane between the alternating intake and discharge positions.

18. A method for fabricating a toothbrush with a pump comprising:

providing a lower portion of a pump housing and an upper portion of the pump housing;

inserting a flexible membrane having an actuator disposed thereon between the upper and lower portions of the pump housing and forming an inlet flap valve and an outlet flap valve in the flexible membrane;

securing the upper portion of the housing to the lower portion of the housing while retaining at least a portion of the membrane between the upper and lower portions of the pump housing; and positioning the pump housing on the toothbrush.

* * * * *